US008824928B2

(12) United States Patent
Kawamura

(10) Patent No.: US 8,824,928 B2
(45) Date of Patent: Sep. 2, 2014

(54) CHARGING APPARATUS AND IMAGE FORMING APPARATUS

(75) Inventor: Takeshi Kawamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 13/809,804

(22) PCT Filed: Aug. 16, 2011

(86) PCT No.: PCT/JP2011/071767

§ 371 (c)(1),
(2), (4) Date: Jan. 11, 2013

(87) PCT Pub. No.: WO2012/036314

PCT Pub. Date: Mar. 22, 2012

(65) Prior Publication Data

US 2013/0114977 A1 May 9, 2013

(30) Foreign Application Priority Data

Sep. 17, 2010 (JP) ..... 2010-208714

(51) Int. Cl.
*G03G 15/26* (2006.01)
*G03G 15/05* (2006.01)
*G03G 13/05* (2006.01)

(52) U.S. Cl.
USPC ..... 399/153; 399/168; 399/174; 399/127

(58) Field of Classification Search
USPC ..... 399/128, 158, 174
See application file for complete search history.

(56) References Cited

U.S. PATENT DOCUMENTS

| | | | | | |
|---|---|---|---|---|---|
| 4,290,690 | A | * | 9/1981 | Noda et al. | 399/153 |
| 5,512,983 | A | * | 4/1996 | Fukushima et al. | 399/153 |
| 2001/0024580 | A1 | * | 9/2001 | Kusunose | 399/111 |

FOREIGN PATENT DOCUMENTS

| | | | | |
|---|---|---|---|---|
| JP | 01028536 | A | * | 1/1989 |
| JP | 04-186380 | A | | 7/1992 |
| JP | 2003-084545 | A | | 3/2003 |
| JP | 2004-309790 | A | | 11/2004 |
| JP | 2007-024993 | A | | 2/2007 |

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A charging apparatus includes a latent image bearing member having a charge generating layer for generating an electric charge by receiving light energy; a light source for emitting light energy for generating the electric charge in the charge generating layer; an electrode; a bias voltage applying portion for applying a bias voltage to the electrode; and an elastic member, which is insulative and transparent, for contacting the electrode to a surface of the latent image bearing member. The electric charge is generated in the charge generating layer by reception of the light energy emitted from the light source, and the surface of the latent image bearing member is electrically charged by applying the bias voltage from the bias voltage applying portion to the electrode. The electrode is provided on the elastic member and is contacted to the surface of the latent image bearing member in a contact area and does not extend to an outside of the contact area.

6 Claims, 9 Drawing Sheets

(a)

(b)

CHARGING APPARATUS AND IMAGE FORMING APPARATUS

TECHNICAL FIELD

The present invention relates to a charging apparatus for electrically charging a latent image bearing member such as a photosensitive member having a charge generating layer for generating an electric charge by receiving light energy and relates to an image forming apparatus including the charging apparatus.

BACKGROUND ART

Various charging apparatuses capable of ozone-less charging or ultimate ozone reduction and remarkable low-voltage charging without modifying a principal part of a photosensitive member and capable of sufficient contribution from the viewpoints of environment, electrical safety and electric power cost have been proposed.

For example, Japanese Laid-Open Patent Application (JP-A) 2003-084545 discloses an image forming apparatus in which a charging apparatus includes a light source for emitting light for generating an electric charge in the charge generating layer, a light transparent electrode (light transmissive electrode) through which the light from the light source is passable, and a bias voltage applying means for applying the bias voltage to the light transparent electrode. Then, the bias voltage is applied to the light transparent electrode while irradiating a certain area of a photosensitive drum with light from the light source via the light transparent electrode, so that a charged state is kept at a downstream side of a light irradiation area with respect to a movement direction of the photosensitive drum. Then, on the surface of the photosensitive drum in the charged state, an electrostatic latent image is formed by an exposure unit.

JP-A Hei 04-186380 discloses a charging apparatus, used in an image forming apparatus for forming an image by electrostatic latent image technology, for charging a photosensitive member which has an internal polarization effect. The charging apparatus includes a charging belt which has a medium-level volume resistivity and is an endless flexible light-transmissive (transparent) member. The charging apparatus further includes first to third rollers which are provided and spaced apart from each other, which act so as to bring the charging belt into intimate contact with the photosensitive member and which have volume resistivity levels lower than that of the charging belt. The first roller is grounded. The second roller is biased so that it has the substantially same potential as a polarization surface potential of the charging belt but has an opposite polarity to that of the polarization surface potential. The third roller is biased so that it has the substantially same potential as the polarization surface potential of the charging belt and has an identical polarity to that of the polarization surface potential. The charging apparatus further includes a light source, provided between the first and second rollers, for irradiating the photosensitive member with light through the charging belt. Further, the charging belt and the photosensitive member are moved, at their intimate contact portion, in the same direction at the same speed.

In the above-constituted charging apparatus for the photosensitive member, between the first and second rollers, the surface of the photosensitive member is charged to a potential of an opposite polarity to the charge polarity of the second roller, i.e., to the polarization surface potential by a potential, having a gradient, generated in the charging belt and by the light irradiation from the light source.

Further, between the second and third rollers, the potential of the charging belt varies from the polarization surface potential of the opposite polarity to the polarization surface potential of the identical polarity. However, the photosensitive member is not subjected to the light irradiation and therefore the charged state of the surface is kept as it is. When the charging belt is separated (spaced) from the photosensitive member after passing through the third roller, the charging belt and the photosensitive member have the same potential and therefore electric discharge is not caused, so that a harmful substance is not generated.

Further, when the first to third rollers are each constituted by an electroconductive roller having an elastic surface, it is possible to provide a tension to the charging belt so as to be intimately contacted to the photosensitive member.

However, as in the above-described conventional constitutions, in the case of an internal polarization charging type in which an electron pair is generated on the photosensitive drum by reception of the light energy, an intimate contact property between the electrode member and the photosensitive drum is important. In the case where the intimate contact property is insufficient, there arose a problem that image defect such a white dropout (patch) or non-uniformity was caused by electric discharge at the intimate contact portion. Further, in the constitution of JP-A 2003-084545, the light transparent electrode is not intimately contacted to the surface of the photosensitive drum. Further, in the constitution of JP-A Hei 04-186380, the charging apparatus itself is complicated and upsized, thus failing to lead to downsizing and cost reduction required for the image forming apparatus in recent years.

DISCLOSURE OF THE INVENTION

The present invention provides a further development of the above-described conventional constitutions.

According to an aspect of the present invention, there is provided a charging apparatus comprising:

a latent image bearing member having a charge generating layer for generating an electric charge by receiving light energy;

a light source for emitting light energy for generating the electric charge in the charge generating layer;

an electrode;

bias voltage applying means for applying a bias voltage to the electrode; and an elastic member, which is insulative and transparent, for contacting the electrode to a surface of the latent image bearing member, wherein the electric charge is generated in the charge generating layer by reception of the light energy emitted from the light source, and the surface of the latent image bearing member is electrically charged by applying the bias voltage from the bias voltage applying means to the electrode, and wherein the electrode is provided on the elastic member and is contacted to the surface of the latent image bearing member in a contact area and does not extend to an outside of the contact area.

These and other objects, features and advantages of the present invention will become more apparent upon a consideration of the following description of the preferred embodiments of the present invention taken in conjunction with the accompanying drawings.

Figure 3:
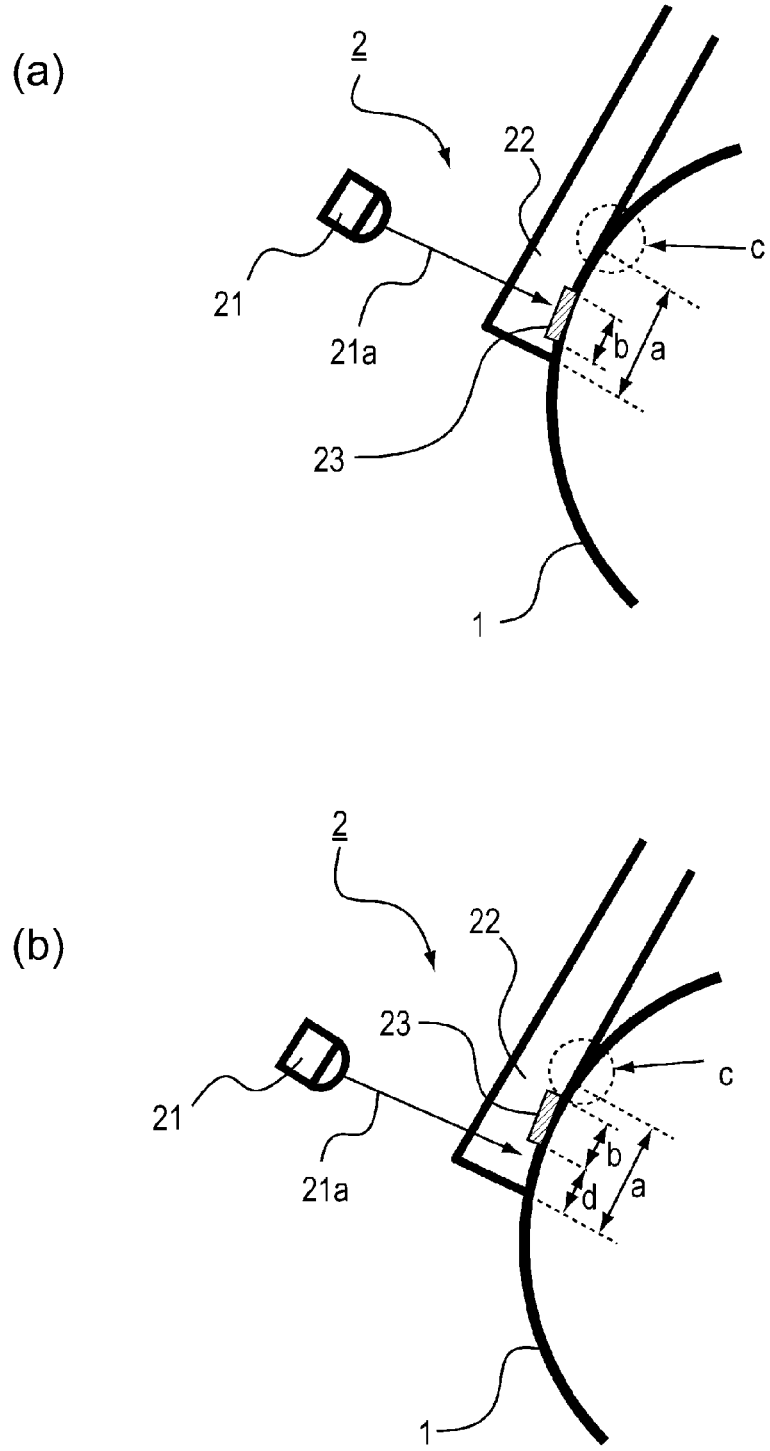

Parts (a) and (b) of FIG. 3 are enlarged schematic views showing a structure of a charging apparatus in Embodiment 1.

Figure 4:
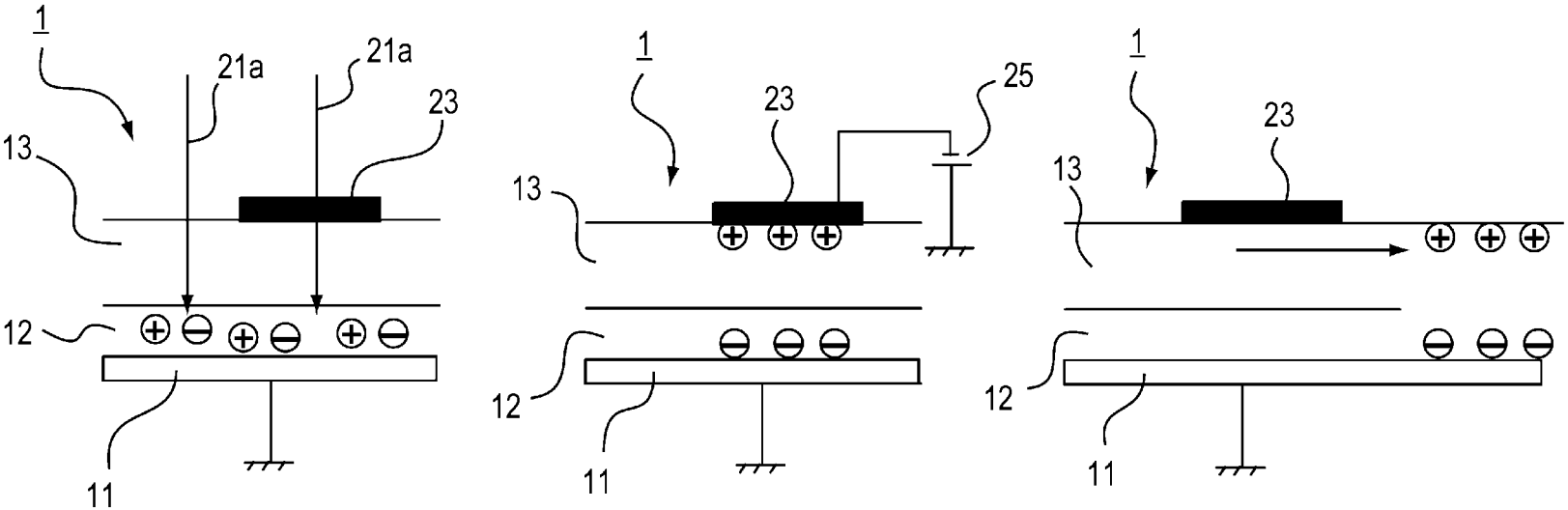

Parts (a), (b) and (c) of FIG. 4 are schematic views for illustrating a charging mechanism.

Figure 5:
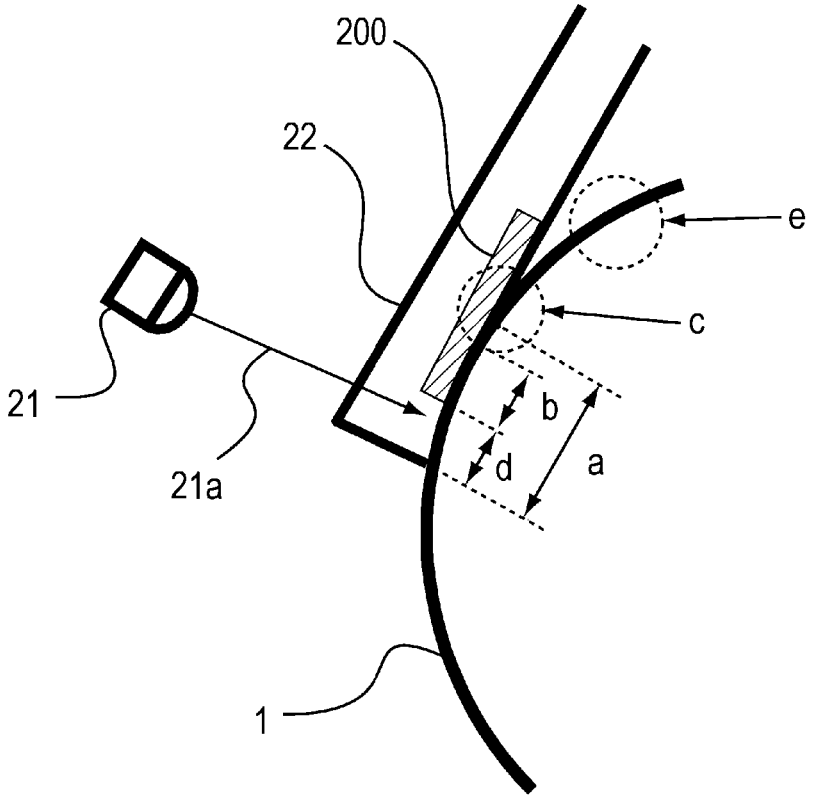

FIG. 5 is an enlarged schematic view showing a structure of a charging apparatus in a comparative embodiment.

Figure 6:
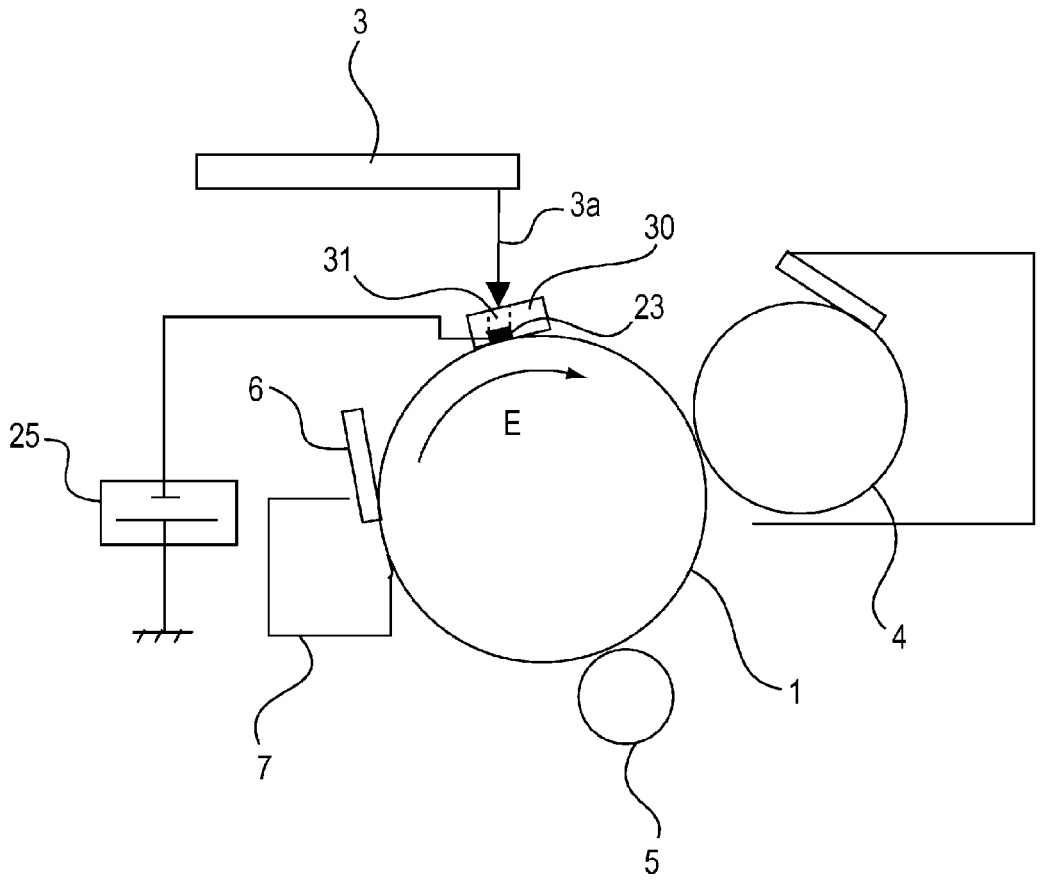

FIG. 6 is a schematic sectional view showing a structure of a latent image bearing member and its peripheral members in Embodiment 2.

Figure 7:
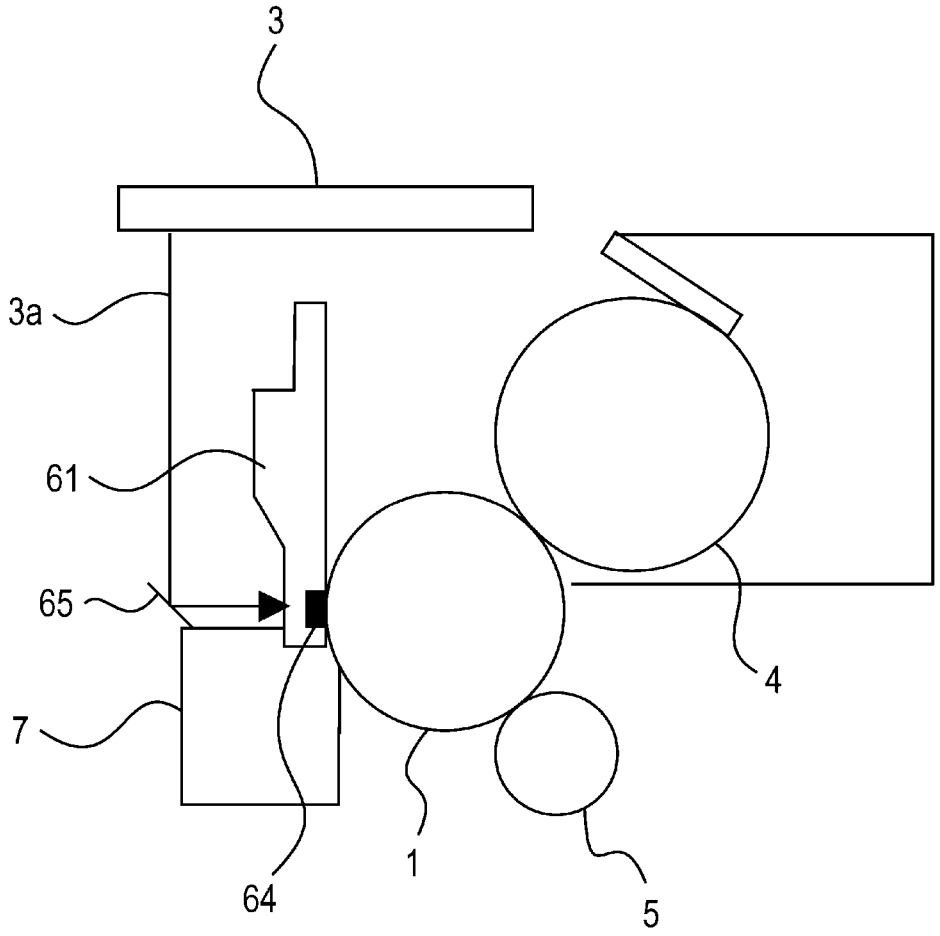

FIG. 7 is a schematic sectional view showing a structure of a latent image bearing member and its peripheral members in Embodiment 3.

Figure 8:
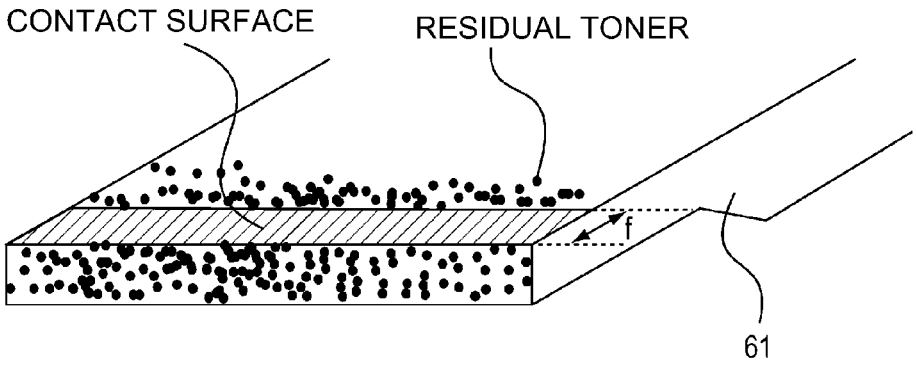
Figure 8:
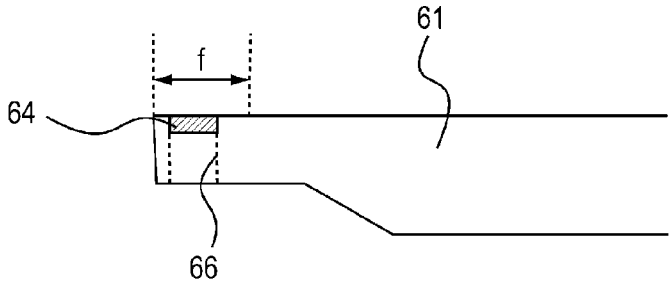

Parts (a) and (b) of FIG. 8 are schematic views for illustrating contamination of a cleaning blade with a residual toner in Embodiment 3.

Figure 9:
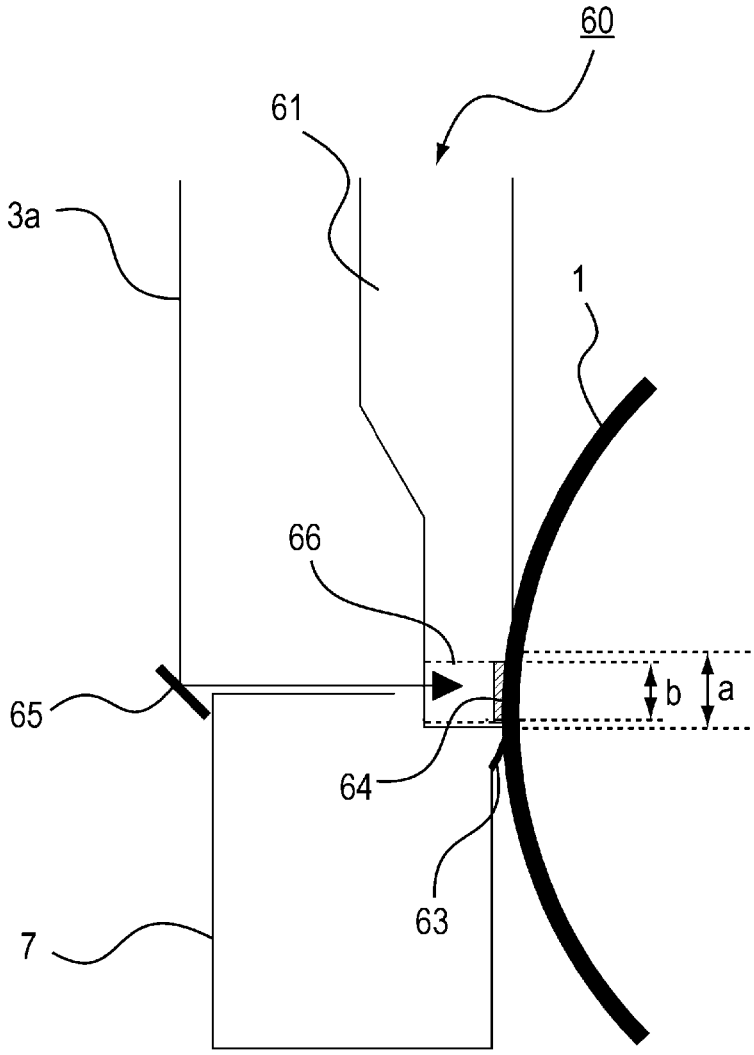

FIG. 9 is an enlarged schematic view of a cleaning unit in Embodiment 3.

BEST MODE FOR CARRYING OUT THE INVENTION

[Embodiment 1]

A structure of an image forming apparatus including a charging apparatus in this embodiment according to the present invention will be described with reference to FIGS. 1 to 4.

Figure 1:
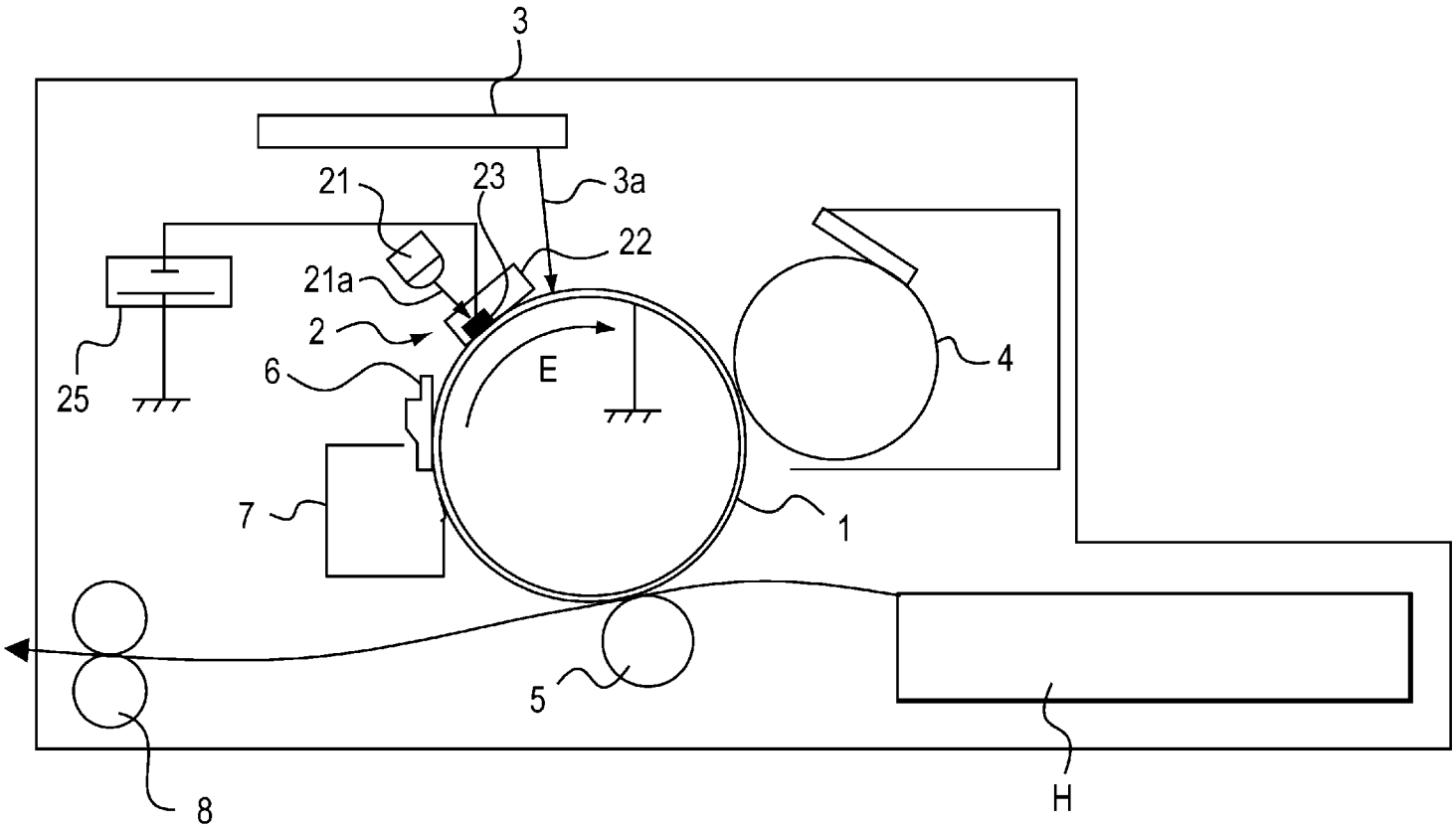
FIG. 1 is a schematic sectional view showing a structure of an image forming apparatus including a charging apparatus according to the present invention in Embodiment 1.

In FIG. 1, a photosensitive drum 1 as a latent image bearing member (electrostatic latent image bearing member) having a charge generating layer 12 for generating an electric charge by receiving light energy rotates in an arrow E direction. The photosensitive drum 1 is irradiated with light 21*a*, for generating the electric charge in the charge generating layer 12, emitted from a light source 21, so that a positive and negative electron pair is generated in the charge generating layer 12. Thereafter, to a light transparent electrode 23 for forming an electric field at the surface of and inside the photosensitive drum 1, a negative voltage of −400 V is applied from a power source 25 as a bias voltage applying means for applying a bias voltage. Further, a drum base (substrate) 11, of the photosensitive drum 1, constituted by an aluminum layer having electroconductivity is grounded. As a result, a potential difference is provided inside the photosensitive drum 1. Then, of the positive and negative electron pair generated in the charge generating layer 12, the positive potential is carried onto the surface of the photosensitive drum 1, so that the surface of the photosensitive drum 1 is uniformly charged. Next, by an exposure unit 3 as an exposure means for exposing the surface of the photosensitive drum 1 to light depending on image information, exposure 3*a* of laser light is emitted, so that an electrostatic latent image depending on the image information is formed on the surface of the photosensitive drum 1. By the rotation of the photosensitive drum 1, the electrostatic latent image reaches a position of a developing device 4, where the electrostatic latent image is visualized as a toner image.

The visualized toner image on the photosensitive drum 1 is transferred onto a recording medium H as a transfer material by a transfer roller 5. Transfer residual toner remaining on the photosensitive drum 1 without being transferred is scraped off (removed) by a cleaning blade 6 as a cleaning means and is accommodated in a residual toner container 7. The photosensitive drum 1 subjected to the cleaning is repeatedly subjected to the above-described operations to effect image formation. On the other hand, the recovery medium H on which the toner image is transferred is, after the toner image is permanently fixed thereon by a fixing device 8, discharged to the outside of the image forming apparatus.

Figure 2:
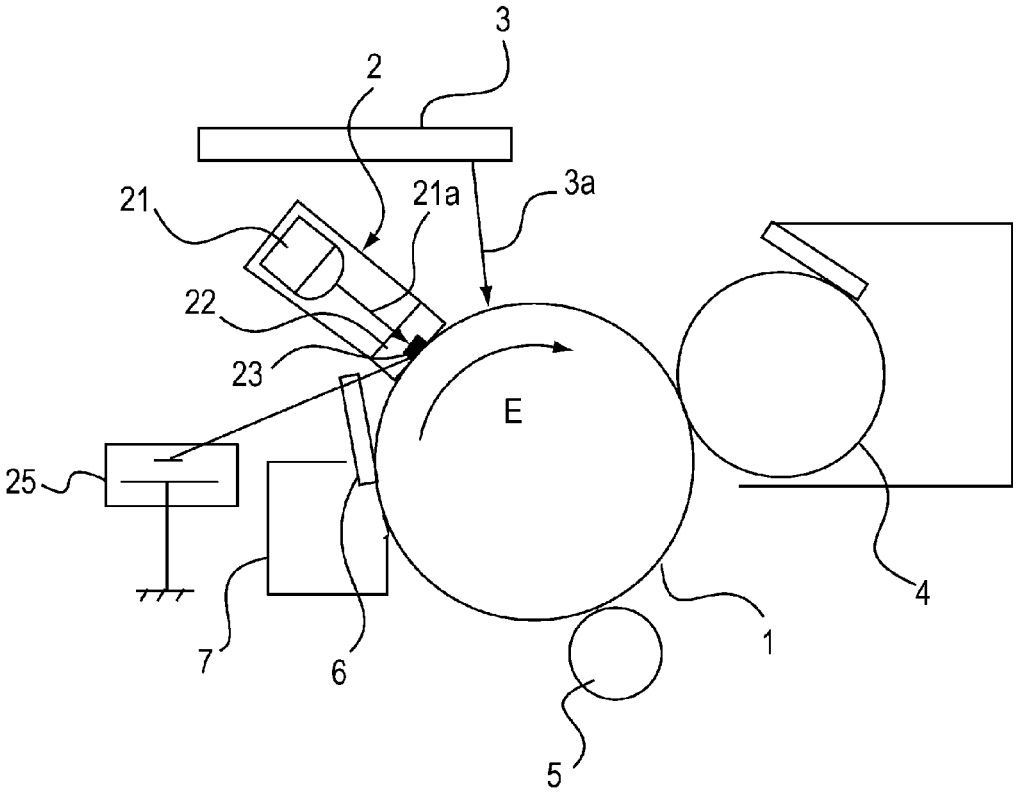
FIG. 2 is a schematic sectional view showing a structure of a latent image bearing member and its peripheral members in Embodiment 1.

FIG. 2 is a schematic sectional view showing a structure of the charging apparatus in this embodiment at a periphery of the photosensitive drum 1. In FIG. 2, around the photosensitive drum 1, the charging unit 2, the exposure unit 3, the developing device 4, the transfer roller 5 as the transfer means and the cleaning blade 6 as the cleaning means are provided clockwise.

Next the charging unit 2 will be described with reference to (a) and (b) of FIG. 3. Parts (a) and (b) of FIG. 3 are enlarged schematic views of the charging unit 2. The charging unit 2 includes the light transparent electrode 23 through which the light is passable, an elastic blade (elastic member) 22 which is insulative and transparent and is configured to bring the light transparent electrode 23 into contact to the surface of the photosensitive drum 1, and the light source 21 for emitting the light 21*a*. The charging unit 2 is provided along a longitudinal direction of the photosensitive drum 1. The elastic blade 22 is constituted by an insulating member and is formed with a transparent material of urethane or silicone for permitting light transmission. The elastic blade 22 is constituted by an elastic material so as to be contacted to the surface of the photosensitive drum 1. As the material for the light transparent electrode 23, it is possible to employ $In_2O_3$ (indium oxide), $SnO_2$ (tin oxide) and the like.

In this embodiment, the electric charge is generated in the charge generating layer 12 by reception of the light energy emitted from the light source 21. By the electric field formed by applying the bias voltage from the power source 25 as the bias voltage applying means to the light transparent electrode 23, the electric charge generated in the charge generating layer 12 is moved to the surface of the photosensitive drum 1 to charge the surface of the photosensitive drum 1. Further, the light transparent electrode 23 is provided on the elastic blade 22 and is disposed within a blade contact area a in which the elastic blade 22 contacts the surface of the photosensitive drum 1 when the elastic blade 22 is contacted to the surface of the photosensitive drum 1. Further, the light transparent electrode 23 is constituted so as not to be present at least in a spaced area c in which the elastic blade 22 is spaced from the photosensitive drum 1.

Next, with reference to (a) to (c) of FIG. 4, a charging mechanism of the surface of the photosensitive drum 1 by the charging unit will be described. The photosensitive drum 1 includes, from its inner side, an electroconductive drum support (base) 11 of aluminum or the like, the charge generating layer 12 for generating the electric charge by receiving the light, and a charge transporting layer for transporting the electric charge. The charge generating layer 12 is formed of a photoconductor, and the light 21*a* emitted from the light source 21 is sensitive light capable of generating the electric charge with respect to the photoconductor of the charge generating layer 12. As shown in (a) of FIG. 4, positive and negative electric charges are generated when the light 21*a* emitted from the light source 21 is incident on the charge generating layer 12 after passing through the elastic blade 22 of the transparent material, the light transparent electrode 23 and the charge transporting layer 13. Thereafter, before the positive and negative charges are re-coupled, an electric field is applied between the grounded drum support 11 and the light transparent electrode 23 to which the negative voltage is applied from the power source 25. As a result, as shown in (b) of FIG. 4, the positive and negative electric charges generated in the charge generating layer 12 are separated correspondingly to the polarity of the grounded drum support 11 and the polarity of each electrode of the light transparent electrode 23 supplied with the negative voltage from the power source 25, so that the charged state is formed. Then, as shown in (c) of FIG. 4, these charges are moved by the rotation of the photosensitive drum 1 and are deviated from the irradiation area of the light 21*a*, thus being transferred into a dark place. This substantially leads to stop or interruption of the light irradiation, so that the charges are not readily moved and thus the charged state is kept in an image writing area by the exposure unit 3. However, in the case of a hole transporting material, the polarities (+ and −) of the bias voltage are reversed.

Thus, the charged state can be obtained by applying the bias voltage while irradiating the photosensitive drum 1 with the sensitive light and is kept by the movement of the photosensitive drum 1 from the irradiation area of the light 21*a*. The bias voltage in this embodiment is principally intended to separate the charges in the charge generating layer 12. For this reason, at the level of the bias voltage, ozone is not generated and even at the bias voltage of about 50 V to about 350 V, a good charged state can be obtained. Thus, it is possible to realize remarkable reduction in voltage and electric power cost.

With reference to (a) and (b) of FIG. 3, a relationship and the like between the contact area between the elastic blade 22 and the photosensitive drum 1 and the contact area between the light transparent electrode 23 and the photosensitive drum 1 will be described. Parts (a) and (b) of FIG. 3 are schematic views showing a cross-section perpendicular to an axial direction of the rotation of the photosensitive drum 1. Referring to (a) of FIG. 3, in order to realize the contact of the elastic blade 22 to the surface of the photosensitive drum 1, the elastic blade 22 is contacted to the photosensitive drum 1 with a penetration depth (entering amount) of 1.5 mm. Here, an area (region) in which the elastic blade 22 and the photosensitive drum 1 contact each other is referred to as a blade contact area a. The blade contact area a ranges from the position of an upstreammost contact point with respect to the rotational direction of the photosensitive drum 1 in FIG. 3 to the position of a downstreammost contact point. An area in which the light transparent electrode 23 and the photosensitive drum 1 contact each other is referred to as an electrode contact area b. A width of the electrode contact area b is less than a width of the blade contact area a as shown in FIG. 3. The elastic blade 22 is constituted by an insulating material, so that a portion where the photosensitive drum 1 and the elastic blade 22 are spaced is electrically insulative. For this reason, even when the bias voltage is applied to the light transparent electrode 23, in a spaced area c in which the elastic blade 22 and the photosensitive drum 1 are spaced in FIG. 3, first, the electric charges corresponding to the separating electric discharge area are accumulated on the elastic blade 22 since the elastic blade 22 is insulative even when the separating electric discharge somewhat occurs. Thereafter, continuous separating electric discharge is not caused. For that reason, it is possible to prevent the image defect such as the white dropout due to leakage.

Further, as shown in (b) of FIG. 3, even when the light transparent electrode 23 is located at the position immediately after the position of the irradiation with the light 21*a*, it is possible to obtain the same effect as in the constitution shown in (a) of FIG. 3. However, the elastic blade 22 is transparent in an area d, through which the light 21*a* passes, as shown in (b) of FIG. 3.

Here, by using a constitution of a comparative embodiment shown in FIG. 5, the effect of the constitution in this embodiment will be described more specifically. In the constitution in the comparative embodiment shown in FIG. 5, an electrode 200 provided on the elastic blade 22 is present so as to extend to the spaced area c in which the photosensitive drum 1 and the elastic blade 22 are spaced. Other constituent elements are similar to those in Embodiment 1 and therefore are represented by the same reference numerals or symbols and will be omitted from detailed description.

In the comparative embodiment shown in FIG. 5, the electrode 200 is present so as to extend over the spaced area c in which the photosensitive drum 1 and the elastic blade 22 are spaced. In this case, the surface of the photosensitive drum 1 is charged to about +300 V and the electrode 200 is charged to −400 V. For this reason, in the spaced area c, the electric discharge occurs. For that reason, the potential of the surface of the photosensitive drum 1 in an area e is dropped to the negative (−) side. Therefore, the white dropout or non-uniformity due to leakage occurs in the image.

On the other hand, in Embodiment 1, the light transparent electrode 23 is disposed so as not to be present in the spaced area c in which the elastic blade 22 and the photosensitive drum 1 are spaced (separated). As a result, first, even when the separating electric discharge somewhat occurs, the elastic blade 22 is insulative and therefore the electric charges corresponding to the separating electric discharge are accumulated on the elastic blade 22. Thereafter, continuous electric discharge is not caused. For that reason, it is possible to prevent the image defect such as the white dropout due to leakage.

[Embodiment 2]

A constitution of an image forming apparatus including the charging apparatus according to the present invention in this embodiment will be described with reference to FIG. 6. Constituent elements similar to those in Embodiment 1 are represented by the same reference numerals or symbols and will be omitted from description.

In Embodiment 1, the surface of the photosensitive drum 1 is uniformly charged by using the light source 21. In this embodiment, exposure light 3*a* which is laser light emitted from the exposure unit 3 as the exposure means is directly passed through the light transparent electrode 23 on an elastic blade 30 which is insulative and transparent and is contacted to the photosensitive drum 1 at the light transparent electrode 23 side. As a result, a surface potential difference of the photosensitive drum 1 is provided between a portion irradiated with the exposure light 3*a* and a portion which is not irradiated with the exposure light 3*a* and by using the potential difference, the latent image is formed. Then, the latent image is developed.

In FIG. 6, the light transparent electrode 23 on the elastic blade 30 is directly irradiated with the exposure light 3*a* from the exposure unit 3 as the exposure means for exposing the photosensitive drum 1 depending on the image information. For this reason, in order to ensure an optical path of the elastic blade 30, the elastic blade 30 also having the function of a light guide 31 which constitutes the optical path through which the light is passed to the elastic blade 30 is used. In this embodiment, at least the light guide 31 portion of the elastic blade 30 is transparent. The light guide 31 may also be constituted by separate member to constitute the optical path.

Thus, the light transparent electrode 23 provided on the elastic blade 30 is directly irradiated with the exposure light 3*a*, so that the steps of charging and exposure are performed at one position. Therefore, a latitude of arrangement of the peripheral members of the photosensitive drum 1 is increased, so that the photosensitive drum 1 can be downsized. Thus, the image forming apparatus is also downsized. Other constitutions are similar to those in Embodiment 1, thus achieving the same effect as in Embodiment 1.

[Embodiment 3]

A constitution of an image forming apparatus including the charging apparatus according to the present invention in this embodiment will be described with reference to FIGS. 7 to 9. Constituent elements similar to those in Embodiment 1 are represented by the same reference numerals or symbols and will be omitted from description.

In this embodiment, a cleaning blade 61 as the cleaning means for removing the residual toner as a residual developer on the surface of the photosensitive drum 1 is constituted so as to also function as the elastic blade. The cleaning blade 61 also functioning as the elastic blade is provided with a light transparent electrode 64, which is insulative and transparent, constituted so as to be contacted to the surface of the photosensitive drum 1. The light transparent electrode 64 forms the electric field at the surface of and inside the photosensitive drum 1.

As shown in FIG. 7, in the case where the above-described elastic blade is constituted as the elastic blade 61, the light transparent electrode 64 is disposed in an area other than the area in which the residual toner is present. In study of the present inventor, the cleaning blade 61 was observed after the image forming apparatus was operated. As a result, it was found, as shown in (a) of FIG. 8, that there is an area f (indicated by a hatched line), in which the residual toner is not present, at the position of the contact surface between the cleaning blade 61 and the photosensitive drum 1. Therefore, as shown in (b) of FIG. 8, the light transparent electrode 64 is disposed in the area f. The light transparent electrode 64 is disposed as shown in (b) of FIG. 8 so as to be fitted in the cleaning blade 61, so that the surface of the light transparent electrode 64 facing the photosensitive drum 1 does not protrude therefrom.

By employing such constitution, it is possible to not only irradiate the surface of the photosensitive drum 1 with the exposure light 3*a* with reliability but also prevent block of the exposure light 3*a* by contamination with the residual toner. In addition, the steps of charging and exposure can be centrally performed at one position, so that the charging apparatus can be remarkably downsized.

A cleaning unit 60 in this embodiment will be described in detail with reference to FIG. 9. FIG. 9 is an enlarged schematic view of a portion where the cleaning unit 60 and the photosensitive drum 1 contact each other. The cleaning unit 60 includes the cleaning blade 61 for scraping off the residual toner in contact with the surface of the photosensitive drum 1 and includes a residual toner container 7 for collecting the scraped toner. The cleaning unit 60 further includes a scooping sheet 63 for effecting sealing so as to prevent the residual toner from leaking from the residual toner container 7 and includes the light transparent electrode 64 provided at the position where the cleaning blade 61 contacts the surface of the photosensitive drum 1. The cleaning unit 60 also includes a folding-back mirror 65 for the exposure light 3*a* and includes a light guide 66 for facilitating passing of the exposure light 3*a*.

The cleaning blade 61 is formed of a transparent material of urethane or silicone and is flexible. The cleaning blade 61 is contacted to the surface of the photosensitive drum 1 with a nip of about 100 μm or more from its edge. The width of the blade contact area as shown in FIG. 9 is the nip width. At the blade contact position, the light transparent electrode 64 is disposed. The width of the light transparent electrode 64 was made less than the blade contact area a which was the nip width between the cleaning blade 61 and the photosensitive drum 1. The electrode contact area b in FIG. 9 is the width of the light transparent electrode 64. As the material for the light transparent electrode 64, $In_2O_3$ (indium oxide), $SnO_2$ (tin oxide) and the like can be employed. The exposure light 3*a* passes through the light guide 66, the transparent cleaning blade 61 and the light transparent electrode 64 to reach the charge generating layer 12 of the photosensitive drum 1. Other constitutions are similar to those in Embodiments 1 and 2 and can achieve the same effects as in Embodiments 1 and 2.

[Industrial Applicability]

As described in Embodiments 1 to 3, according to the present invention, it is possible to ensure an intimate contact property between an electrode and a latent image bearing member, so as to prevent image defect such as white dropout or non-uniformity generated by electric discharge from a portion where the electrode is spaced from the latent image bearing member.

While the invention has been described with reference to the structures disclosed herein, it is not confined to the details set forth and this application is intended to cover such modifications or changes as may come within the purpose of the improvements or the scope of the following claims.

The invention claimed is:

1. A charging apparatus comprising:

a latent image bearing member having a charge generating layer for generating an electric charge by receiving light energy;

a light source for emitting light energy for generating the electric charge in the charge generating layer;

an electrode;

bias voltage applying means for applying a bias voltage to said electrode; and an elastic member, which is insulative and transparent, for contacting said electrode to a surface of said latent image bearing member, wherein the electric charge is generated in the charge generating layer by reception of the light energy emitted from said light source, and the surface of said latent image bearing member is electrically charged by applying the bias voltage from said bias voltage applying means to said electrode, and wherein said electrode is provided on said elastic member and is contacted to the surface of said latent image bearing member in a contact area and does not extend to an outside of the contact area.

2. An apparatus according to claim 1, wherein said electrode is a light transparent electrode through which light is passable, and the light from said light source passes through the light transparent electrode.

3. An apparatus according to claim 1, wherein said elastic member also functions as cleaning means for removing a residual developer on the surface of said latent image bearing member.

4. An apparatus according to claim 2, wherein exposure light from exposure means for effecting exposure depending on image information is passed through the light transparent electrode.

5. An apparatus according to claim 1, wherein said elastic member includes a light guide for passing the light through said elastic member.

6. An image forming apparatus comprising:

a charging apparatus according to claim 1.

* * * * *